US010361488B1

(12) United States Patent
Ng et al.

(10) Patent No.: US 10,361,488 B1
(45) Date of Patent: Jul. 23, 2019

(54) DIELECTRIC MATERIAL AS ANTENNA

(71) Applicant: Antwave Intellectual Property Limited, Hong Kong (HK)

(72) Inventors: Kung Bo Ng, Hong Kong (HK); Chun Kai Leung, Hong Kong (HK); Ming Lu, Hong Kong (HK); Hang Wong, Hong Kong (HK); Chi Sun Yu, Hong Kong (HK)

(73) Assignee: Antwave Intellectual Property Limited, Hong Kong (HK)

( * ) Notice: Subject to any disclaimer, the term of this patent is extended or adjusted under 35 U.S.C. 154(b) by 0 days.

(21) Appl. No.: 16/155,885

(22) Filed: Oct. 9, 2018

Related U.S. Application Data

(60) Provisional application No. 62/645,130, filed on Mar. 19, 2018.

(51) Int. Cl.

| | |
|---|---|
| ***H01Q 1/38*** | (2006.01) |
| ***H01Q 13/02*** | (2006.01) |
| ***H01Q 9/04*** | (2006.01) |
| ***H01Q 1/24*** | (2006.01) |

(52) U.S. Cl.
CPC ..... *H01Q 13/0283* (2013.01); *H01Q 1/243* (2013.01); *H01Q 1/38* (2013.01); *H01Q 9/0407* (2013.01)

(58) Field of Classification Search
CPC .... H01Q 13/0283; H01Q 1/38; H01Q 9/0407; H01Q 1/243
USPC ..... 343/700 MS
See application file for complete search history.

(56) References Cited

U.S. PATENT DOCUMENTS

| | | | | |
|---|---|---|---|---|
| 8,378,893 | B2 * | 2/2013 | Harokopus | H01Q 1/523 343/700 MS |
| 2011/0273342 | A1 * | 11/2011 | Park | H01Q 1/243 343/702 |
| 2012/0218723 | A1 * | 8/2012 | Kwak | H01Q 1/243 361/748 |

FOREIGN PATENT DOCUMENTS

| | | | |
|---|---|---|---|
| CN | 107464995 | A | 12/2017 |

OTHER PUBLICATIONS

International Search Report of PCT Patent Application No. PCT/CN2018/109717 dated Dec. 29, 2018.

* cited by examiner

*Primary Examiner* — Hai V Tran

(57) ABSTRACT

A dielectric material antenna is disclosed. The antenna includes a first material layer made up of a first material with a low dielectric constant. A surface pattern containing pits is carved out of the first material layer. The pits carved out are then filled up with a second material layer made up of a second material that has a high dielectric constant than the first material layer to form a first antenna layer. A wave launcher is provided near to the first antenna layer with a ground provided at its bottom. The wave launcher helps to couple the energy generated from an energy source to the first antenna layer in order to radiate and receive signals.

19 Claims, 24 Drawing Sheets

Part of EM energy radiates
Part of EM energy jumps
904
900
902

924
926
920
922

700
950
708
952
954

DIELECTRIC MATERIAL AS ANTENNA

CROSS-REFERENCE TO RELATED APPLICATIONS AND PRIORITY

The present application claims priority from U.S. Provisional Patent Application No. 62/645,130 filed on Mar. 19, 2018, incorporated herein as a reference.

TECHNICAL FIELD

This disclosure relates generally to an antenna for user devices, and more particularly to utilizing surface of user devices as a place for antenna formation.

BACKGROUND

User devices, these days are capable of multi-tasking. Users can log in to the web using World Wide Web that requires data services, chat on the go that requires cellular connections, exchange data using short wireless data transfer protocols like Bluetooth, Near Field Communication (NFC) etc. and also collect location information through GPS etc. All these tasks are possible when the user device has the capability of communicating efficiently. For efficient communication, the most basic part required is an antenna. The antenna radiates and receives information. For every type of communication, a different antenna is required.

Since the user devices are capable of carrying out multiple communication protocols at a time, therefore, for such a requirement and functionality the user devices are provided with multiple antennas. There are many antennas such as Bluetooth, GPS, Wi-Fi, 4G, 5G, NFC, RFID, millimeter wave application in 60 GHz or above, etc. that are built within the user devices.

However, the presence of so many antennas requires space. Since there are so many antennas embedded, they occupy much of the space in the user devices. Also, day by day, the size of the user devices is also decreasing. Antennas with other components like battery and LCD display are packed very close together. This tends to affect the functioning of the antennas due to interference from other components. Furthermore, these products are to be used in very close proximity to human body parts such as the arm, head, pockets, etc. This further, seriously affects the performance of the antenna.

Therefore, there is a need for an efficient solution to solve the above-mentioned problems of the antennas.

SUMMARY

This summary is provided to introduce concepts related to systems and methods for serving one or more items and the concepts are further described below in the detailed description. This summary is not intended to identify essential features of the claimed subject matter nor is it intended for use in determining or limiting the scope of the claimed subject matter.

In an implementation, an antenna is described. The antenna comprises a first antenna layer, a wave launcher placed near to the first antenna layer that is configured to couple energy generated from an energy source to the first antenna layer. The antenna further comprises a ground placed at a bottom of the wave launcher. The first antenna layer comprises a first material layer, formed by a first material, that is configured with a surface pattern that contains a plurality of pits. In an aspect, the pits may be of the same volume or may have varied volumes. Further, the first antenna layer includes a second material layer formed by a second material that is filled within the pits of the surface pattern formed on the first material layer. The antenna further comprises an energy source that is configured to generate energy. The first material has a dielectric constant different than a dielectric constant of the second material.

In another implementation, a method to enable a material layer to become an antenna is provided. The method includes forming at least one surface pattern on at least one side of a first material layer formed by a first material. The method further includes the step of implanting, the surface pattern formed, by a second material layer formed by a second material to form a first antenna layer. The dielectric constant of the first material is different from the dielectric constant of the second material. In an implementation, the dielectric constant of the first material is lower than that of the second material. Whereas, in another implementation, the dielectric constant of the first material may be higher than that of the second material. The method further includes a step of placing a wave launcher near the first antenna layer. The wave launcher is configured to couple energy generated from an energy source to the first antenna layer. The method also includes providing a ground at a bottom of the wave launcher.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this disclosure, illustrate exemplary embodiments and, together with the description, serve to explain the disclosed principles.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims.

Furthermore, there is no intention to be bound by any expressed or implied theory presented in the preceding technical field, background, brief summary or the following detailed description. It is also to be understood that the specific systems and methods illustrated in the attached drawings, and described in the following specification, are simply exemplary embodiments of the inventive concepts defined in the appended claims. Specific examples and other characteristics relating to the embodiments disclosed herein are therefore not to be considered as limiting unless the claims expressly state otherwise.

Figure 1:
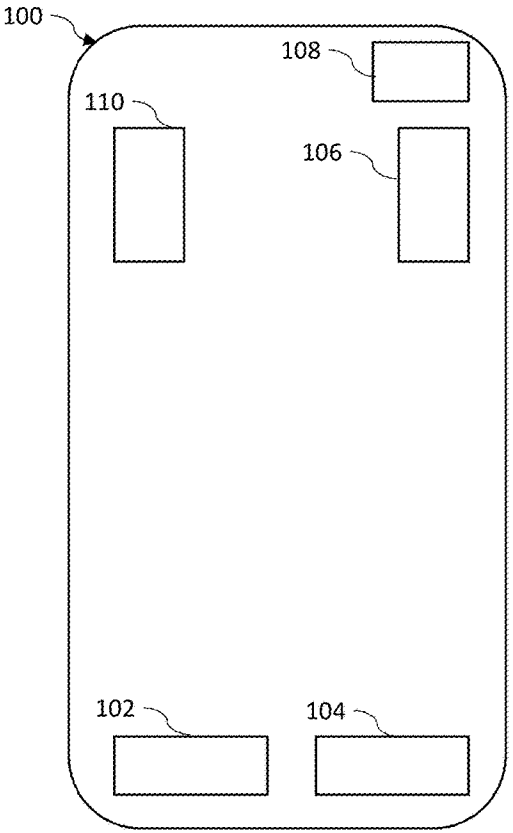
FIG. 1 is an example of a user device and various antennas, in accordance with an embodiment of the invention.

FIG. 1 is an example of a user device 100. The user device 100 may be, according to an embodiment of the invention, however, not limited to the scope of the invention, a wireless device like a smartphone, a smartwatch, a tablet computer, etc. As also depicted in the figure, the user device 100 includes multiple antennas like 102, 104, 106, 108, and 110 in close proximity to each other. The user device 100 may include multiple antennas for multiple uses like 102 may be cellular reception antenna for communication via 2G, 3G, 4G, 5G, etc. 104 antennae may be utilized near field communication (NFC), Bluetooth and Wi-Fi communications. 106 may be utilized for GPS communication, 108 may be utilized for RFID communications, and 110 may have been utilized for millimeter wave applications etc. Hence, all the antennas 102-110 may be utilized for various communications and may also cause various interferences to each other.

Figure 2:
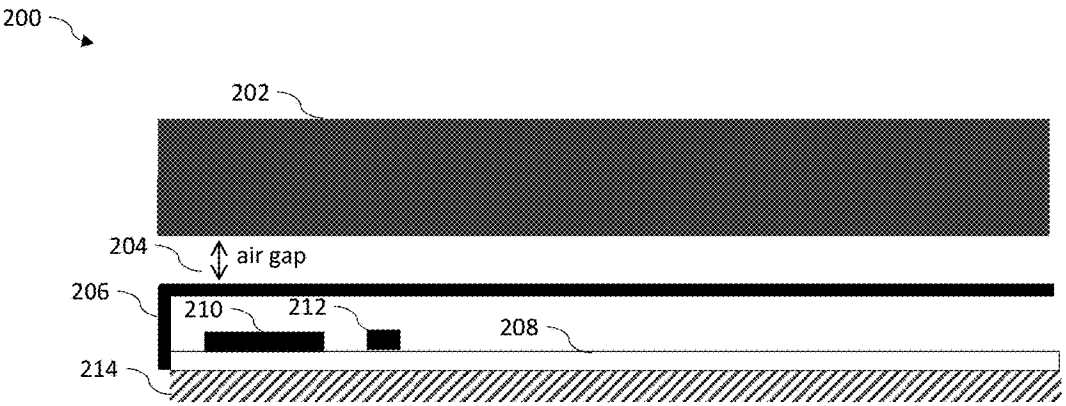
FIG. 2 is a block diagram illustrating an antenna, in accordance with another embodiment of the invention.

FIG. 2, a block diagram, illustrates an antenna 200, in accordance with an embodiment of the invention. The antenna 200 includes a first antenna layer 202, a wave launcher 206 that is placed near the first antenna layer 202. However, there may be an air gap 204 provided in between the wave launcher 206 and the first antenna layer 202. The antenna may further include a PCB module 208 that may be present within the user device 100. Further, the PCB module 208 may have energy source 210 and another RF circuit 212. The antenna 200 is also provided with a ground 214 that may also be present within the user device 100.

In an embodiment of the invention, the first antenna layer 202 is a mixture of a low dielectric constant material and a high dielectric constant material (to be discussed in detail later).

According to another embodiment of the invention the wave launcher 206, may be placed anywhere on the first antenna layer 202. Wave launcher 206 is a feeding device from which, radio frequency (RF) signal energy travels from the RF circuit 212 on the PCB Module 208 to the surface of the first antenna layer 202. The wave launcher 206 may be any one or a combination of a Printed circuit board (PCB), metal pin, Indium Tin Oxide (ITO) on any substrate or any conductive material. Examples of the wave launcher 206 may be a PCB slot feed, a PCB/ITO (Indium Tin Oxide) loop, a patch, a probe feed, etc. The wave launcher 206 may be placed on any surface of the first antenna layer 202. Generally, there is an air gap 204 that is maintained in between the wave launcher 206 and the first antenna layer 202. Different types of wave launchers will be described in detail later in the description.

Figure 3A:
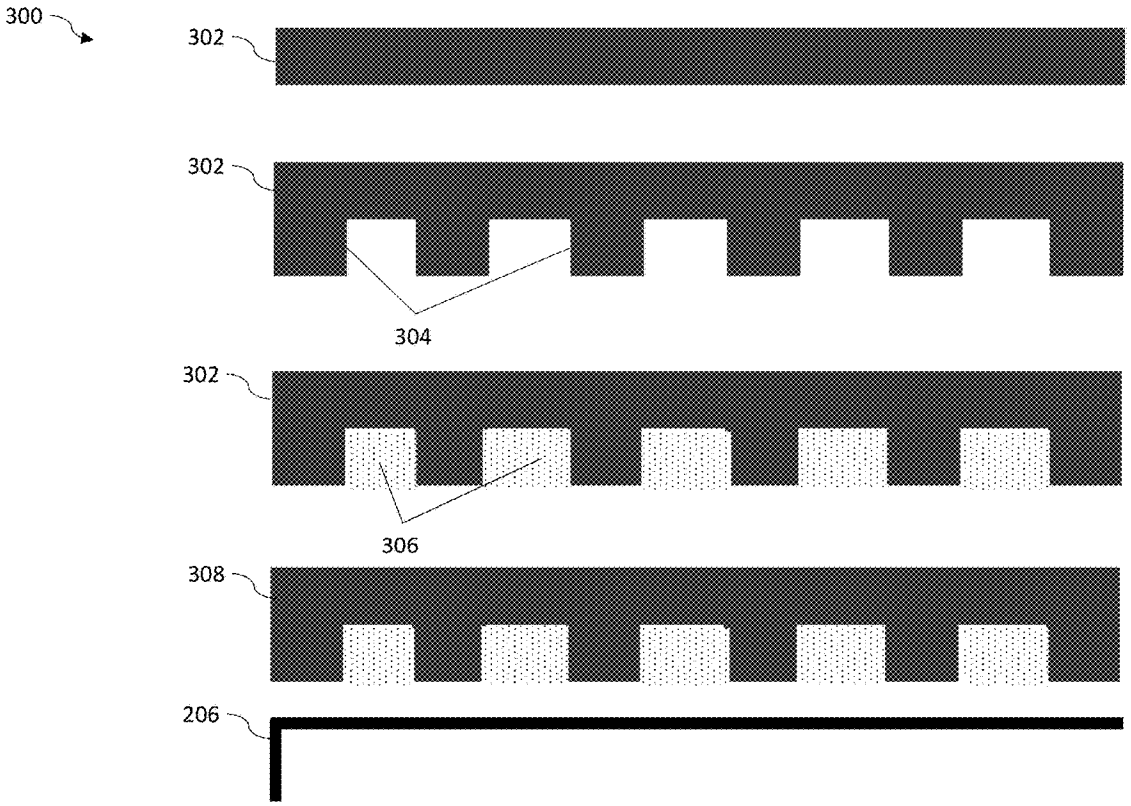
FIG. 3A-3B are block diagrams illustrating antennas, in accordance with yet another embodiment of the invention.

FIG. 3A, a block diagram illustrates a detailed view and construction of various components and their configuration for an antenna 300, similar to the antenna 200, in accordance with another embodiment of the invention. The antenna 300 may include a first material layer 302. The first material layer 302 may be made up of a first material with low dielectric constant. As known in the art, the dielectric constant is the ratio of the permittivity of a substance to the permittivity of free space. It is an expression of the extent to which a material concentrates electric flux and is the electrical equivalent of relative magnetic permeability. As the dielectric constant increases, the electric flux density increases, if all other factors remain unchanged. This enables objects of a given size, such as sets of metal plates, to hold their electric charge for long periods of time, and/or to hold large quantities of charge. According to an implementation of the invention, the first material may be any one or a combination of low dielectric constants like plastic, Acrylonitrile butadiene styrene (ABS), polycarbonate, Polyurethane, Carbon Fiber, Silicone, etc. The dielectric constant of the first material may be within a range of 2-10.

Further as depicted in the figure, a surface pattern 304 is formed on the first material layer 302. The surface pattern may include multiple pits like pattern formed on the surface of the first material layer 302. The surface pattern 304 may either be a regular or irregular pattern. That is, it may be uniformly spread all across the surface of the first material layer 302 or may be present only at some place. Further, the pits created in the surface pattern may be varied as well, details of which will be discussed later in the detailed description. Pits of the surface patterns 304 may then be filled with a second material layer 306 made up of a second material. In an embodiment of the invention, there may be same second material filled within the pits of the surface pattern 304. However, there may be other instances wherein the different pits may have different material etc.

Figure 3B:
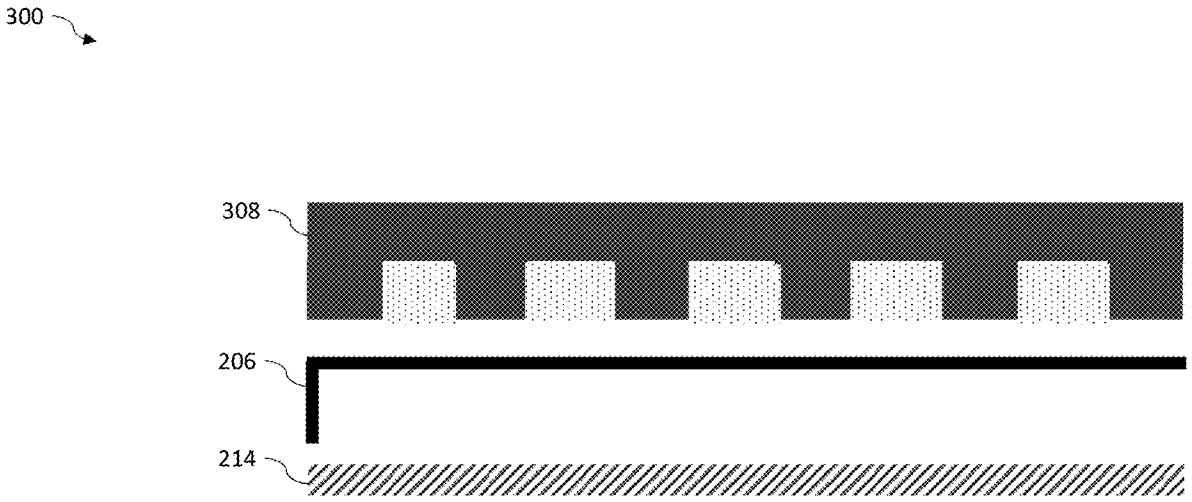

The second material may have a dielectric constant higher than that of the first material. The dielectric constant of the second material may be higher than 10. The second material 304 may be any one or a combination of Alumina, Zirconia, Titanium Dioxide, etc. The addition of the second material layer 304 to the first material layer 302 creates a first antenna layer 308. As described above the wave launcher 206 may then be placed near the first antenna layer 308 and as depicted in FIG. 3B, providing a ground 214 at bottom of the wave launcher 206 to enable the first antenna layer 308 to radiate and receive signals, that is the first antenna layer 308 acts as an antenna module. Each segment of the first antenna layer 308 may form an antenna with different resonant frequency. Therefore, the first antenna layer 308 may function as an antenna that radiates and receives signals of multiple frequencies.

Figure 4A:
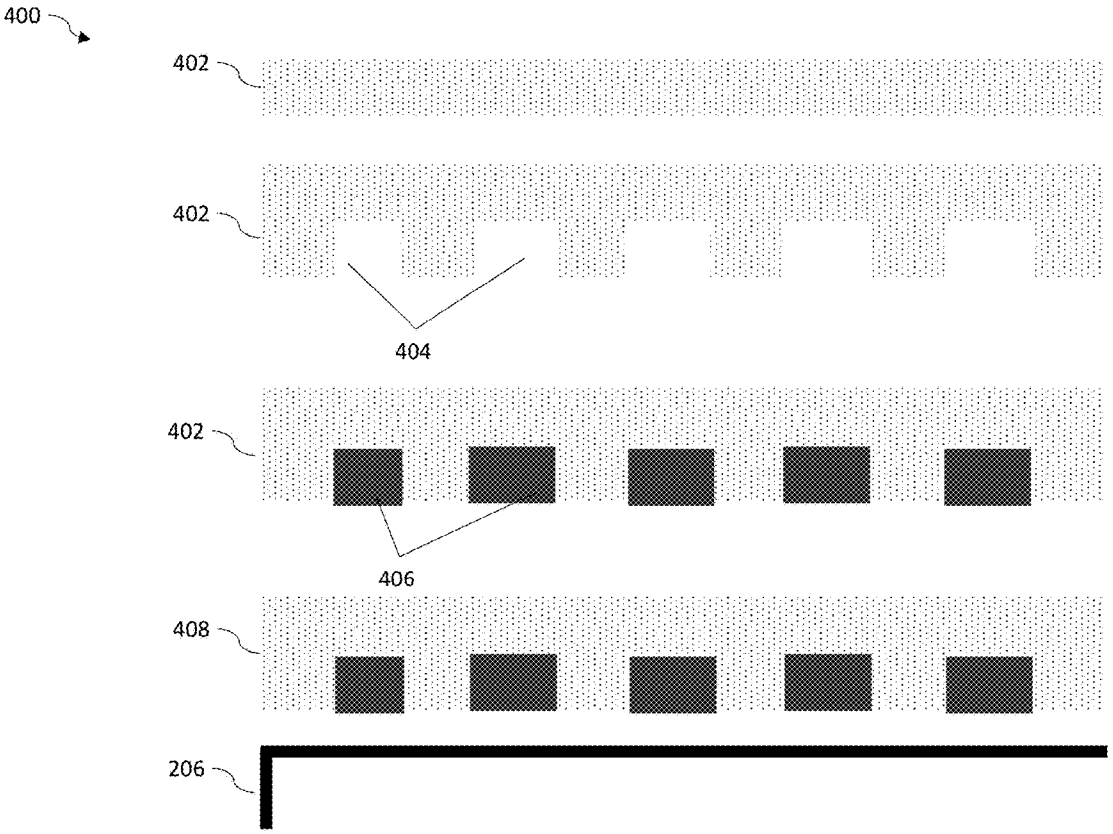
FIG. 4A-4B are block diagrams illustrating antennas, in accordance with yet another embodiment of the invention.

FIG. 4A, a block diagram illustrates a detailed view and construction of various components and their configuration for an antenna 400 similar to antenna 200, in accordance with another embodiment of the invention. The antenna 400 may include a first material layer 402. The first material layer 402 may be made up of a first material with a high dielectric constant. According to an implementation of the invention, the first material may be composed of any one or a combination of high dielectric constant material like Alumina, Zirconia, Titanium Dioxide, etc. The dielectric constant of the first material may be above 10.

Further as depicted in the figure, a surface pattern 404 is formed on the first material layer 402. The surface pattern may include multiple pits like pattern formed on the surface of the first material layer 402. The surface pattern 404 may either be a regular pattern or an irregular pattern that is, either it may be uniformly spread all across the surface of the first material layer 402 or may be confined to only a certain section of the first material layer 402. Further, the pits created in the surface pattern may be varied as well, details of which will be discussed later in the detailed description. Pits of the surface patterns 404 may then be filled with a second material layer 406 made up of a second material. In an embodiment of the invention, the same second material may be filled within the pits of the surface pattern 404. However, there may be other instances wherein the different pits may have different material etc.

Figure 4B:
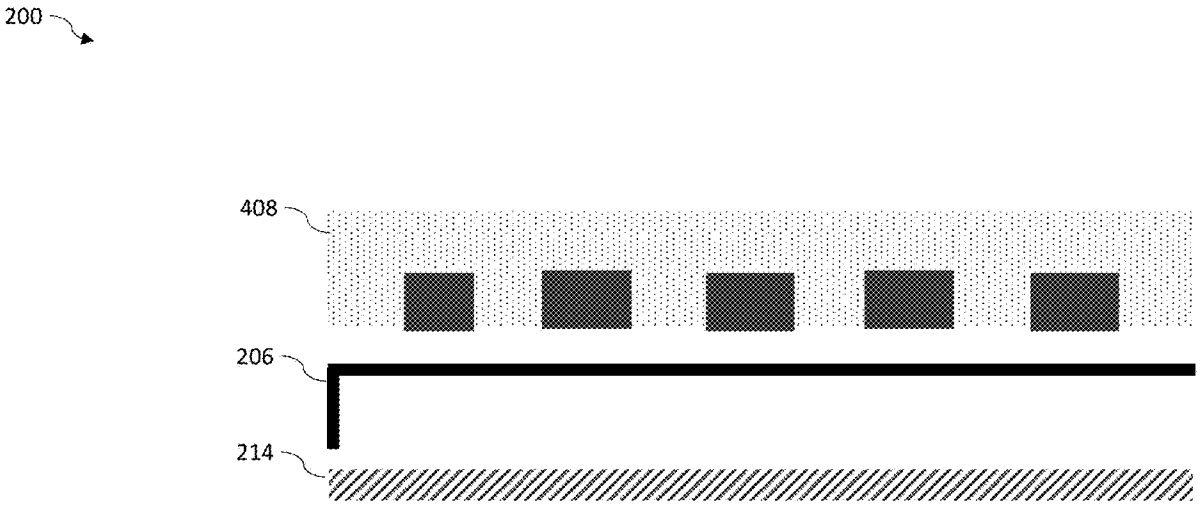

The second material may have a dielectric constant lower than that of the first material. The dielectric constant of the second material may be within a range of 2-10. The second material may be any one or a combination of a plastic, an Acrylonitrile butadiene styrene (ABS), a polycarbonate, a Polyurethane, a Carbon Fiber, a Silicone, etc. The addition of the second material layer 406 to the first material layer 402 creates a first antenna layer 408. As described above the wave launcher 206 may then be placed near the first antenna layer 408 and as depicted in FIG. 4B, is provided with a ground 214 at bottom of the wave launcher 206 to enable the first antenna layer 408 to radiate and receive signals, that is the first antenna layer 408 acts as an antenna module.

Figure 5:
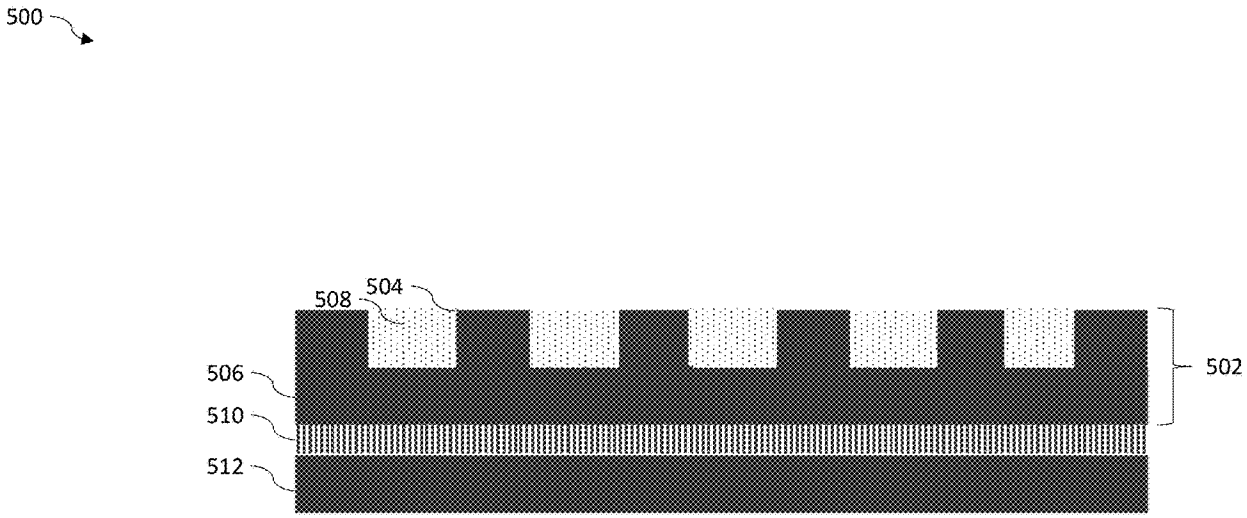
FIG. 5 is a block diagram illustrating a tape type antenna, in accordance with yet another embodiment of the invention.

FIG. 5 illustrates different forms of surfaces within which the invention may be practiced. FIG. 5 displays an antenna 500 (similar to antenna 200). The antenna 500, as described above, may include a first antenna layer 502. The first antenna layer 502 includes a low dielectric constant first material layer 506 having a surface pattern 504 with multiple pits formed on the surface. The pits may be filled up with a second material layer 508 of high dielectric constant. The antenna 500 may have an adhesive surface 510 that may be utilized to stick the antenna 500 on a product surface 512. The product may be a user device like a smartphone etc.

Figure 6:
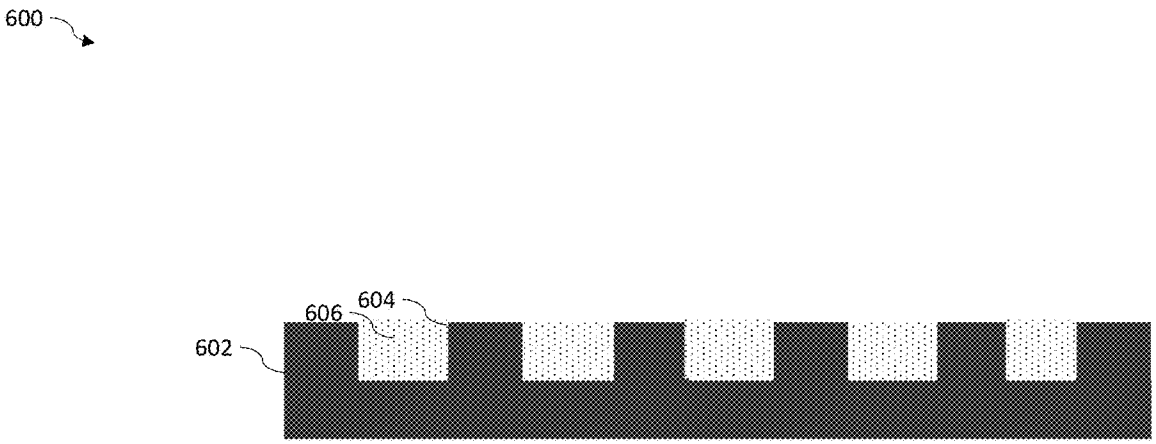
FIG. 6 is a block diagram illustrating antenna on product body, in accordance with yet another embodiment of the invention.

In another embodiment, as depicted in FIG. 6, a product surface 602 may be made up of a lower dielectric material. The low dielectric material layer 602 may again include a surface pattern 604 including pits that may be filled with high dielectric constant material 606. This forms an antenna 600 right on the product surface 602.

Figure 7:
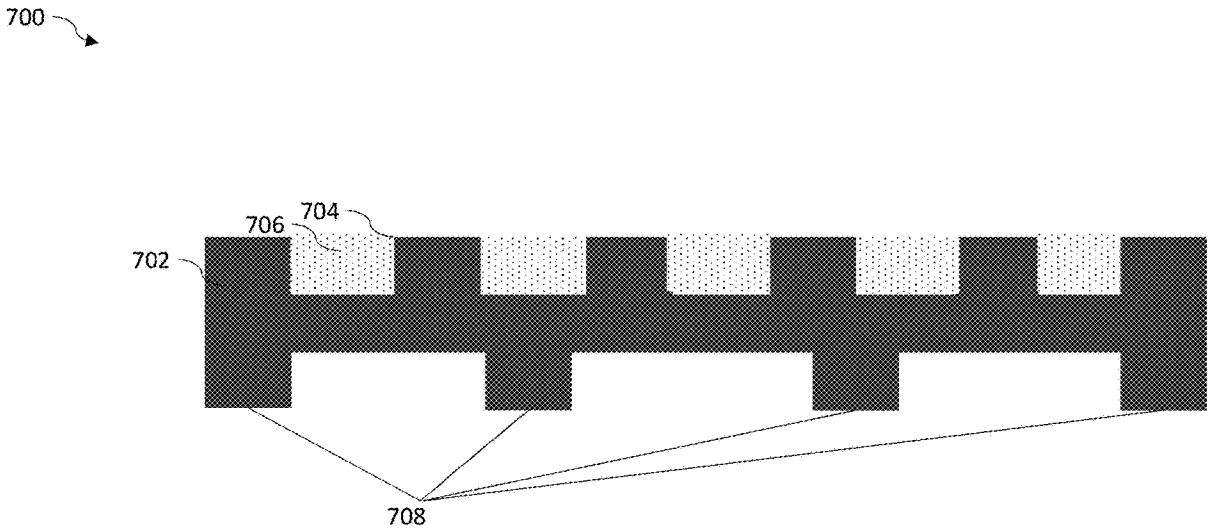
FIG. 7 is a block diagram illustrating a puzzle type antenna, in accordance with yet another embodiment of the invention.

In yet another embodiment, depicted in FIG. 7 of the invention, a puzzle type surface 702 may be made up of a lower dielectric material. The low dielectric material layer 702 may again include a surface pattern 704 including pits that may be filled with high dielectric constant material 706. This forms an antenna 700 right on the puzzle type surface 702. The puzzle type surface 702 may also include puzzle stands 708 that may be placed on a product surface.

Figure 8:
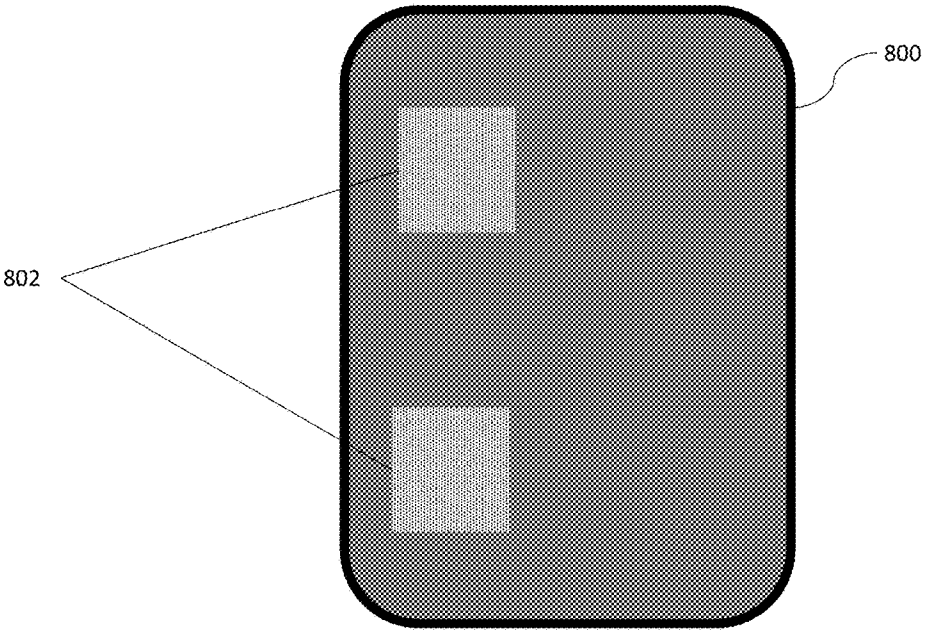
FIG. 8 is a line diagram illustrating placement of the antenna on product body, in accordance with an embodiment of the invention.

FIG. 8, a line diagram illustrates placement of antenna 802 on a surface of a product 800, in accordance with an embodiment of the invention. The product 800 may be a smartphone, a tablet computer, a smartwatch, a router, etc. The antenna 802 as described above may have a tape type structure that may be stuck on to a back side of the product 800. Also, the surface of the product 800 may itself be utilized for creation of the antenna 802. This type of antenna enables removal of an antenna within the product and hence creates availability of more space for other components. Also, moving the antenna 802 out of the product 800 helps in reducing the interference caused to the antenna 802 due to other components of the user device 100 like batteries, capacitors etc.

Figures 9A, 9B, 9C:
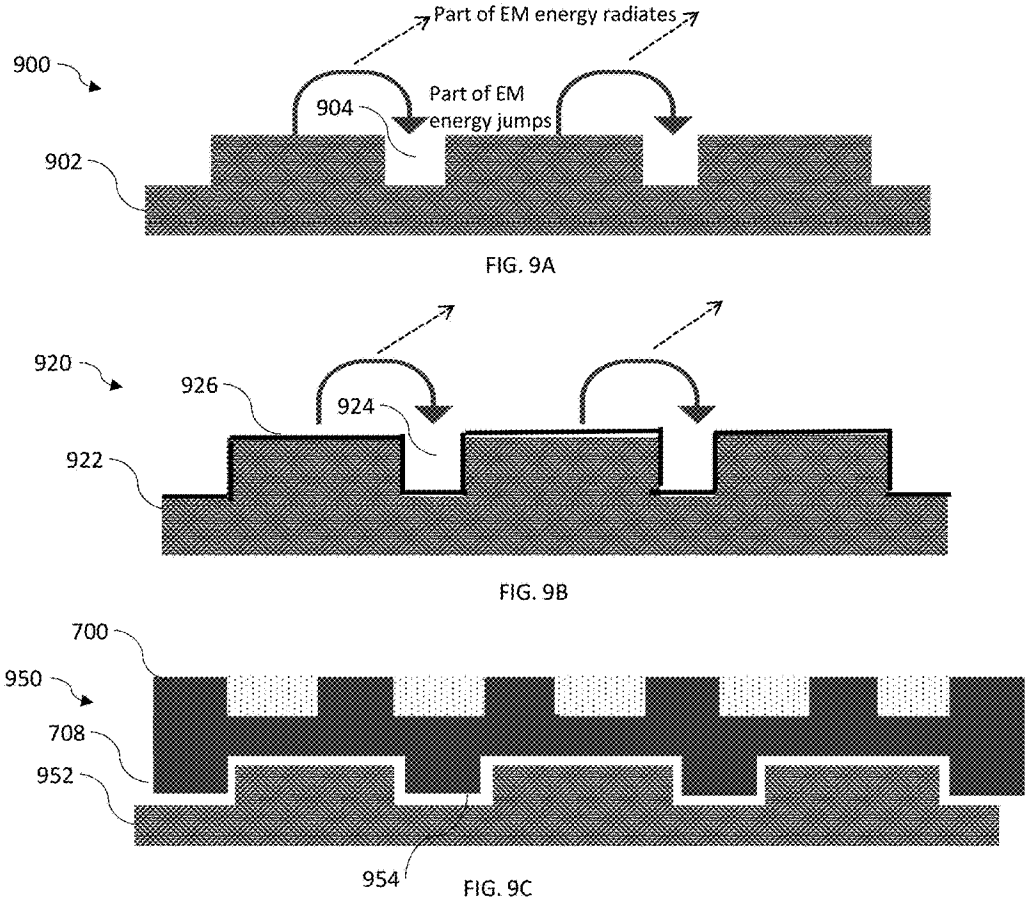
FIG. 9A-9C are block diagrams illustrating functioning modes of puzzle type antennas, in accordance with an embodiment of the invention.

FIG. 9A-9C, block diagrams illustrate functioning modes of puzzle type antennas, in accordance with an embodiment of the invention. FIG. 9A depicts antenna 900 similar to antenna 200. Antenna 900 contains a first antenna layer 902 on which various air gaps 904 are formed. With such a configuration, when the antenna 900 receives EM waves, part of the EM wave energy jumps between the air gaps and a part of it is radiated.

Similarly, as depicted in FIG. 9B, antenna 920 contains a first antenna layer 922 on which various air gaps 924 are formed. The air gaps are coated with an electronic conductive coating 926. As stated earlier in this configuration as well, part of the EM wave energy jumps between the air gaps and a part of it is radiated.

FIG. 9C illustrates another way of using the puzzle type antenna 700 to form an antenna 950. Antenna 950 contains a first antenna layer 952 on which various air gaps 954 are formed. The puzzle type piece 700, as described in conjunction with FIG. 7, may be inserted within gaps 954 using puzzle stands 708.

Figure 10:
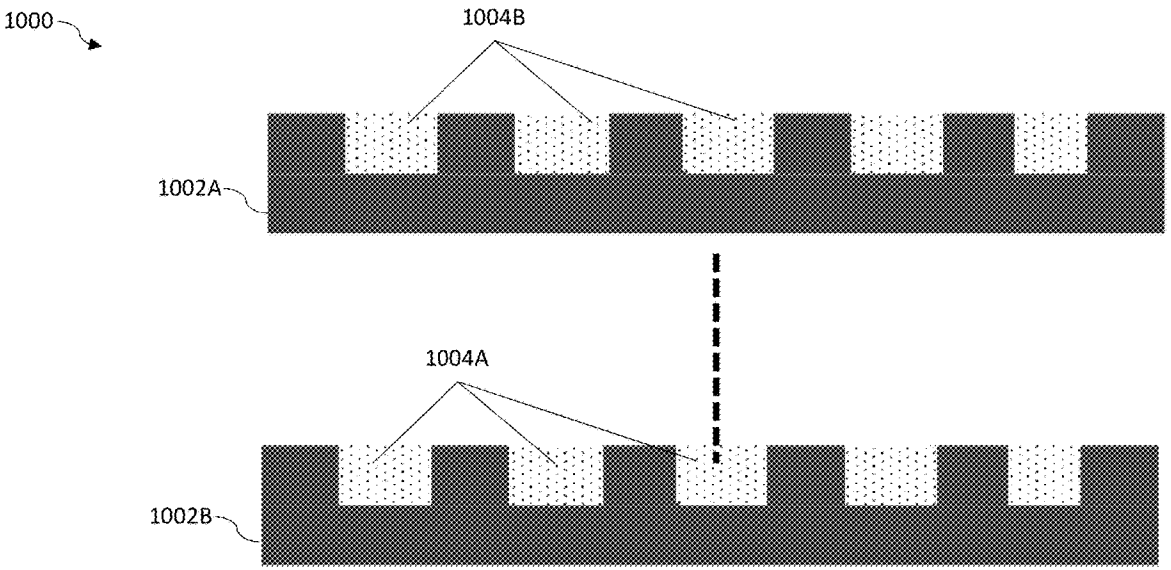
FIG. 10 is a block diagram illustrating a multi-layer antenna, in accordance with an embodiment of the invention.

FIG. 10, a block diagram illustrates a multi-layer antenna 1000, in accordance with an embodiment of the invention. The multi-layer antenna 1000 may include multiple layers of low dielectric material layers like a first antenna layer 1002A made up of a first material and second antenna layer 1002B made up of a third material. Both the first antenna layer 1002A and the second antenna layer 1002B may include a second material layer 1004A made up of a second material layer, and a third material layer 1004B of fourth material layer respectively. According to an embodiment of the invention, there may be more than 2 layers of low dielectric constant material layers joined together to form the functional antenna. In an embodiment of the invention, the first antenna layer 1002A and the second antenna layer 1002B may either have same surface patterns or may have different surface patterns.

According to another embodiment of the invention the first material, the second material, the third material and the fourth material may include any one or a combination of an Acrylonitrile butadiene styrene (ABS), a polycarbonate, a Polyurethane, a Carbon Fiber, and a Silicone.

Figure 11:
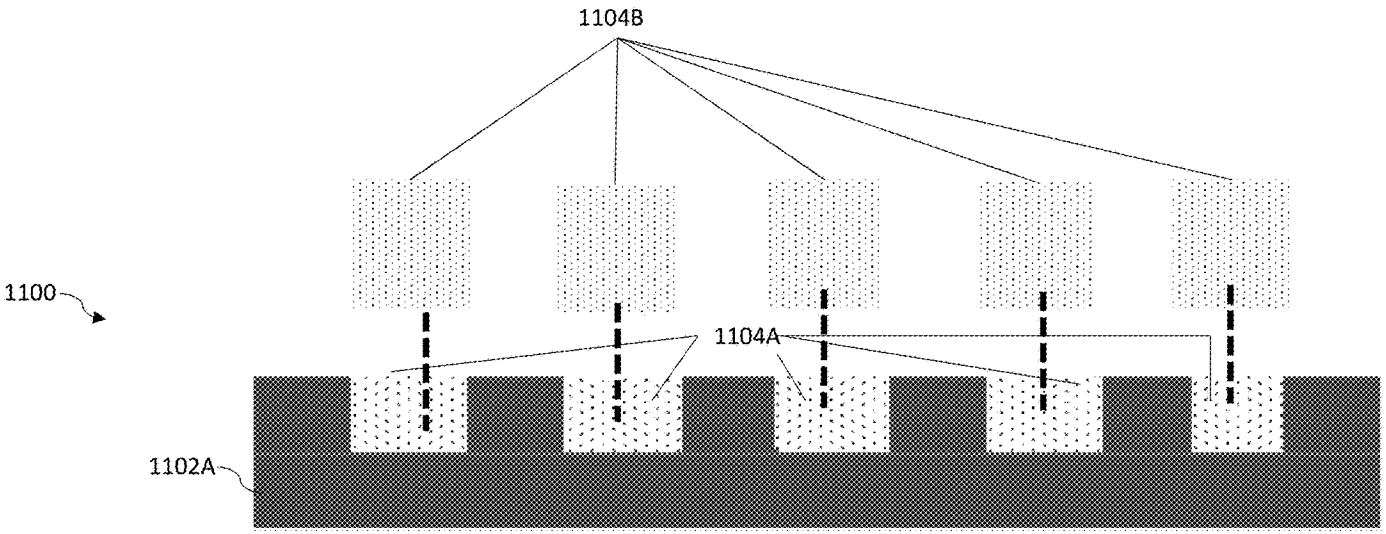
FIG. 11 is a block diagram illustrating a multi-layer antenna, in accordance with another embodiment of the invention.

FIG. 11, a block diagram illustrates a multi-layer antenna 1100, in accordance with an embodiment of the invention. The multi-layer antenna 1100 may include multiple layers of high dielectric material layers like 1104A and 1104B filled within surface patterns with pits formed on the surface of a low dielectric first material layer 1102A. Both 1104A and 1104B may be of same or different high dielectric constant material to form the antenna 1100 that may radiate or receive RF signals. According to an embodiment of the invention, there may be more than 2 layers of high dielectric constant material layers joined together to form a functional antenna.

Figure 12:
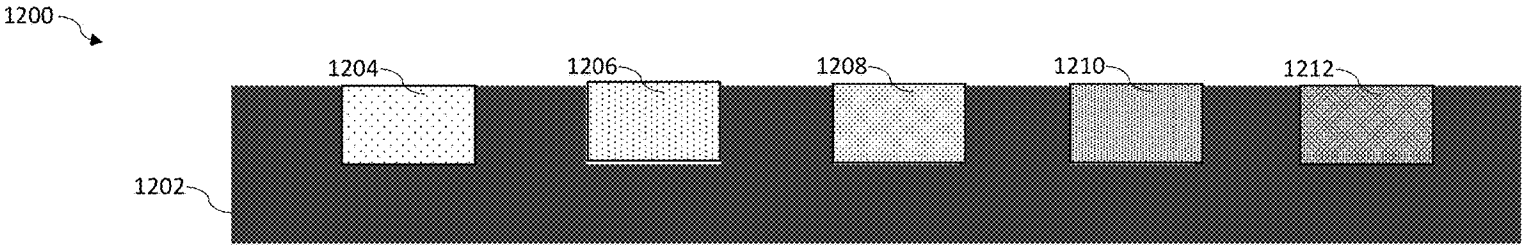
FIG. 12 is a block diagram illustrating an antenna, in accordance with yet another embodiment of the invention.

FIG. 12, a block diagram illustrates an antenna 1200, in accordance with an embodiment of the invention. In this embodiment, the antenna 1200 similar to the antenna 200 includes a first material layer 1202 made up of a first material. The first material layer 1202 may further include a surface pattern including pits. The pits of the may be filled with material layers 1204, 1206, 1208, 1210, and 1212 with dielectric constants higher than that of the first material and different from each other. The presence of different dielectric material in every pit may help the antenna 1200 to radiate or receive signals of different frequencies. Hence, it is possible to have Bluetooth antenna, 3G antenna, 4G antenna and possibly Wi-Fi antenna made within the same material layer. This eliminates the provisioning of placing different antennas and hence provides more space to create slimmer and smaller user devices. Furthermore, in another embodiment of the invention, the antenna 1200 may have more than one antenna layers. The antenna 1200 may have another antenna layer similar in construction and connected to the first antenna layer 1202.

Figure 13A:
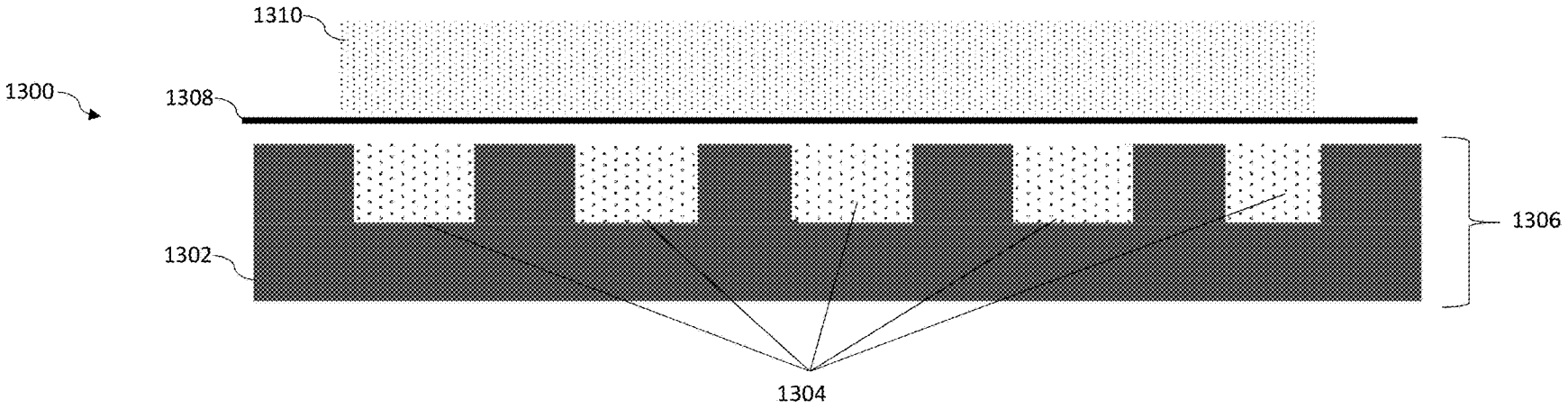
FIG. 13A is a block diagram illustrating an antenna, in accordance with yet another embodiment of the invention.

FIG. 13A, a block diagram illustrates a multilayered antenna 1300, in accordance with another embodiment of the invention. In this embodiment, the antenna 1300 may include a base surface similar to the antenna 200 as discussed above that includes a first material layer 1302, made up of a first material that is a low dielectric constant material. The first material layer 1302 includes a surface pattern including multiple pits filled with a second material layer 1304 made up of a second material having a high dielectric constant than the first material forming a first antenna layer 1306.

Figure 13B:
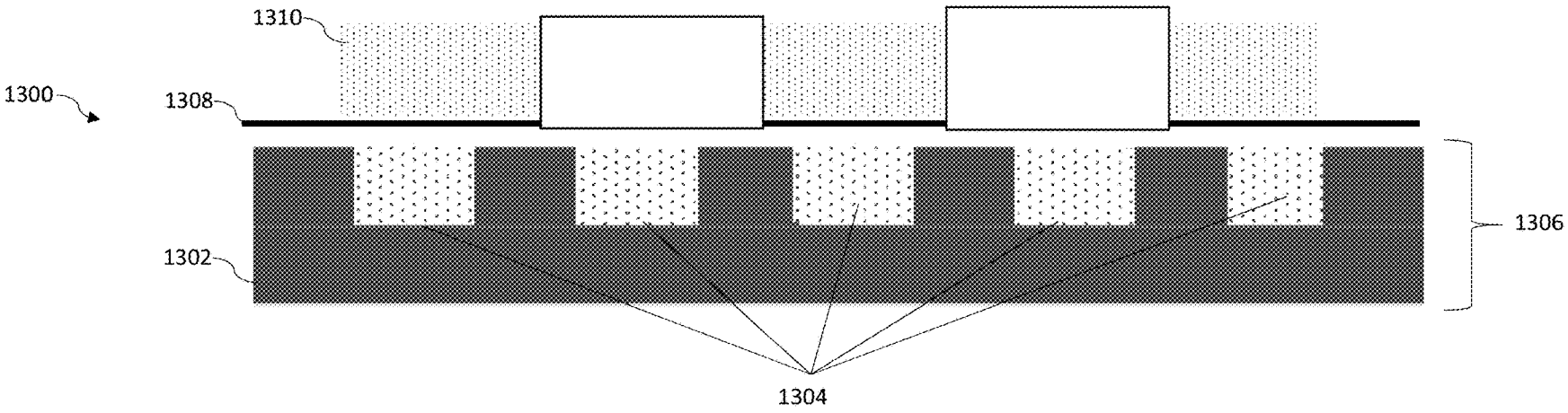
FIG. 13B is a block diagram illustrating an antenna, in accordance with yet another embodiment of the invention.

Further, the antenna 1300 may also include an independent second antenna layer 1308 of a low dielectric constant material, similar to the first material 1302, is laid over the first antenna layer 1306. The second antenna layer 1308 may be in the form of a thin film or a tape placed over the surface of the first antenna layer 1306 as displayed in FIG. 13. Above the second antenna layer 1308, an independent third antenna layer 1310 of high dielectric constant material, similar to the second material 1304, is laid over the second antenna layer 1308. The second antenna layer 1308 may either completely cover the first antenna layer 1306 as depicted in FIG. 13A or discreetly cover the first antenna layer 1306 at regular intervals or irregular intervals as depicted in FIG. 13B. The portions where the second antenna layer 1308 is discreetly present may have dielectric constant material different from the second material 1304, in accordance with another embodiment of the invention. Such a pattern makes the antenna 1300 capable of radiating and receiving RF signals of various frequencies.

Figure 14:
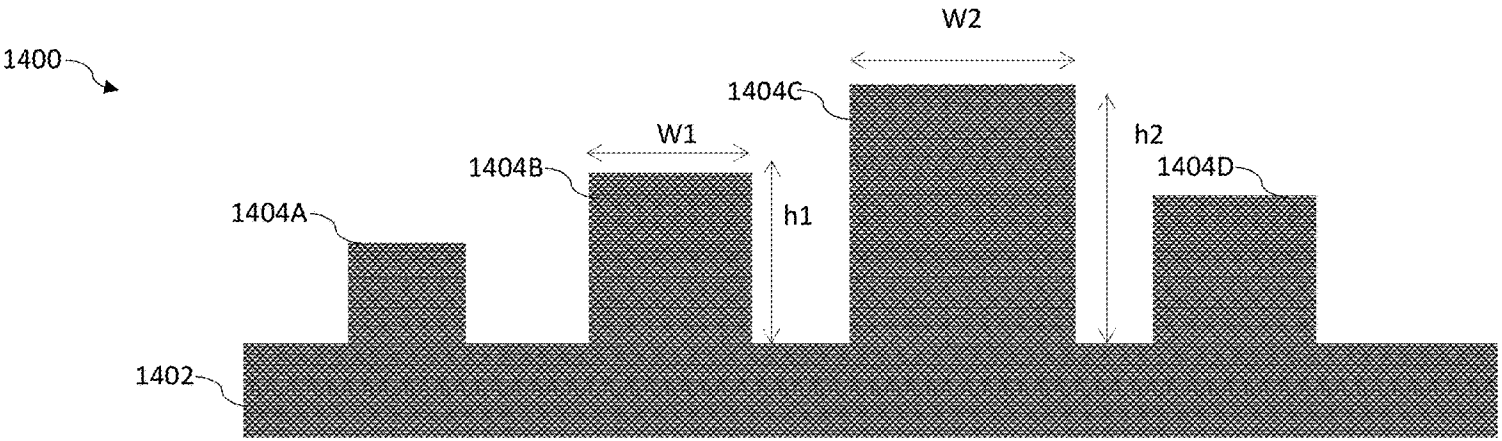
FIG. 14 is a block diagram illustrating an antenna, in accordance with yet another embodiment of the invention.

FIG. 14, a block diagram illustrating an antenna 1400, in accordance with an embodiment of the invention. The antenna 1400 is similar in construction to antenna 200. Similar to antenna 200, the antenna 1400 also has a first antenna layer 1402 and has a surface pattern with pits like 1404A, 1404B, 1404C, and 1404D. In this embodiment, the pits 1404A, 1404B, 1404C, and 1404D may have a variable volume. For example, pit 1404B has a width W1 and a height h1, while pit 1404C has a different width W2 and a different height h2. This helps the antenna 1400 to radiate and receive various frequencies as already discussed above. Due to the variable volume of the pits 1404A, 1404B, 1404C, and 1404D, high dielectric constant material filled within the pits 1404A, 1404B, 1404C, and 1404D also varies and hence the antenna radiates and receives signals of varied frequency due to the varied energy transferred through the pits 1404A, 1404B, 1404C, and 1404D.

FIG. 15A-15E, line diagrams illustrate various types of wave launchers, in accordance with various embodiments of the invention. According to various embodiments, the wave launcher may be in slot form like wave launcher 1500 depicted in FIG. 15A.

Figure 15A:
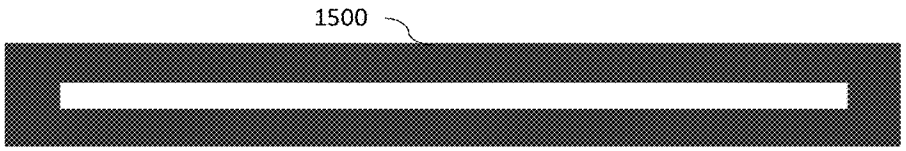
FIG. 15A-15E are line diagrams illustrating types of wave launchers, in accordance with various embodiments of the invention.
Figure 15B:
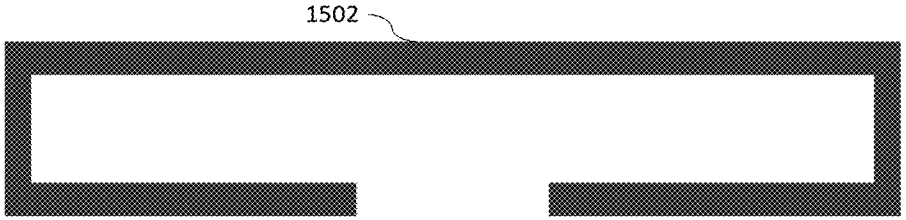
Figure 15C:
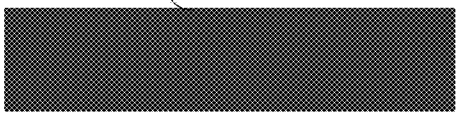
Figure 15D:
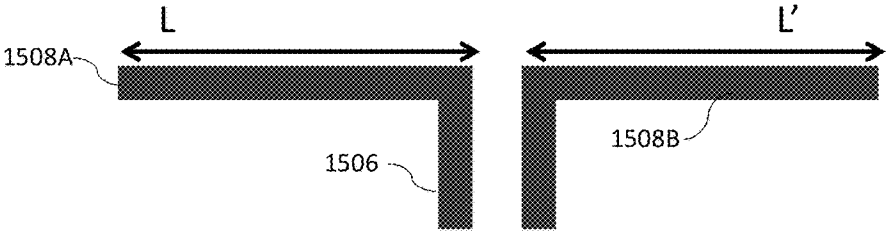

Also, the form 1502 may also be possible that is a slot-like structure as depicted in FIG. 15B. Further possible forms of wave launcher may be a patch like as depicted in 1504 in FIG. 15C and also a dipole-like structure 1506 as shown in FIG. 15D. Wave launcher 1506 may have arms 1508A and 1508B of lengths L and L' of unequal lengths. Due to unequal lengths of the arms 1508A and 1508B, the arms 1508A and 1508B are capable of exciting two different resonant frequencies.

Figure 15E:
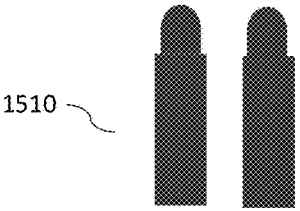

FIG. 15E depicts a connector shaped wave launcher 1510. It may be in the shape of a spring loaded connector, probe, cable, stub, strip, microstrip line, etc. In another embodiment of the invention, the wave launcher 1510 may also be attached to a first material layer and with a second material layer for wave excitation.

The wave launcher(s) 1500, 1502, 1504, and 1506 may be responsible to couple energy to a first antenna layer. The electric field resonant in the fundamental mode of the given structure and to produce a resonances $N*\lambda o/4$ (N=1, 2, 3 . . . ) as a TMN0 (Transverse magnetic) mode-like resonance. The energy reinforces inside the first antenna layer to create resonance $f_M$ (M=1, 2, 3 . . . ). The first antenna layer then radiates or receives electromagnetic wave with its resonance frequency $f_M$ (M=1, 2, 3 . . . ). The wave launcher(s) 1500, 1502, 1504, and 1506 can produce a phase difference of $0° \leq \Theta \leq 90°$ for the resonant frequencies $f_M$ (M=1, 2, 3 . . . ). The resonant at the designated frequencies can generate linear polarization (LP) to circular polarization (CP).

A transverse mode of electromagnetic radiation is a particular electromagnetic field pattern of radiation measured in a plane perpendicular (i.e., transverse) to the propagation direction of the beam. Transverse modes occur in radio waves and microwaves confined to a waveguide, and also in light waves in an optical fiber and in a laser's optical resonator.

Transverse modes occur because of boundary conditions imposed on a wave by the waveguide. For example, a radio wave in a hollow metal waveguide must have zero tangential electric field amplitude at the walls of the waveguide, so the transverse pattern of the electric field of waves is restricted to those that fit between the walls. For this reason, the modes supported by a waveguide are quantized. The allowed modes may be found by solving Maxwell's equations for the boundary conditions of a given waveguide.

Transverse magnetic (TM) modes: no magnetic field in the direction of propagation. These are sometimes called E modes because there is only an electric field along the direction of propagation.

In rectangular waveguides, rectangular mode numbers are designated by two suffix numbers attached to the mode type, such as TEmn or TMmn, where m is the number of half-wave patterns across the width of the waveguide and n is the number of half-wave patterns across the height of the waveguide. In circular waveguides, circular modes exist and here m is the number of full-wave patterns along the circumference and n is the number of half-wave patterns along the diameter.

Figure 16G:
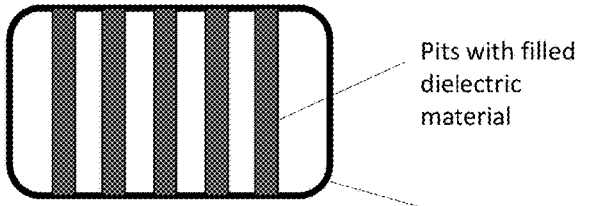
FIG. 16A-16H are line diagrams illustrating types of patterns arrangements on the product surface, in accordance with various embodiments of the invention.
Figure 16H:
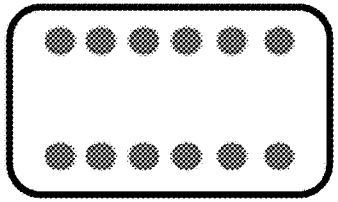
Figure 16D:
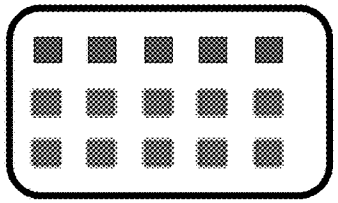
Figure 16E:
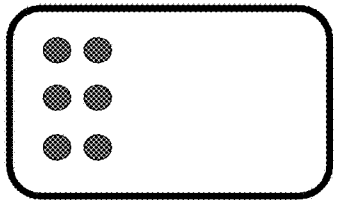
Figure 16F:
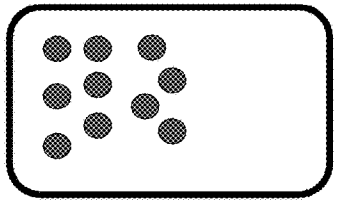
Figure 16A:
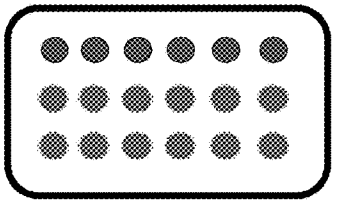
Figure 16B:
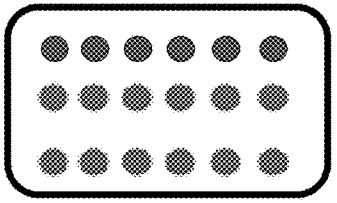

FIG. 16A-16H, line diagrams illustrate types of patterns arrangements on product surface possible, in accordance with various embodiments of the invention. As depicted in FIG. 16A the surface patterns may be regular and spherical shaped. FIG. 16B depicts another spherical type surface pattern. However, the pattern may be irregular as depicted in the FIG. 16B.

Figure 16C:
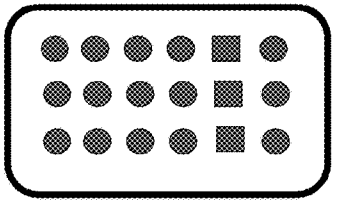

Further, as depicted in FIG. 16C the surface patterns may be regular, however, the shape of the surface pattern may be different. As shown in FIG. 16C there may be a square pattern within the spherically shaped pattern.

FIG. 16D depicts a regular square pattern as depicted. The surface pattern may also be present only in some part of on a product surface as depicted in FIG. 16E, FIG. 16F, and FIG. 16H. FIG. 16G depicts a different type of surface pattern wherein the surface pattern may run from one side of a product surface completely to the other side.

Figure 17:
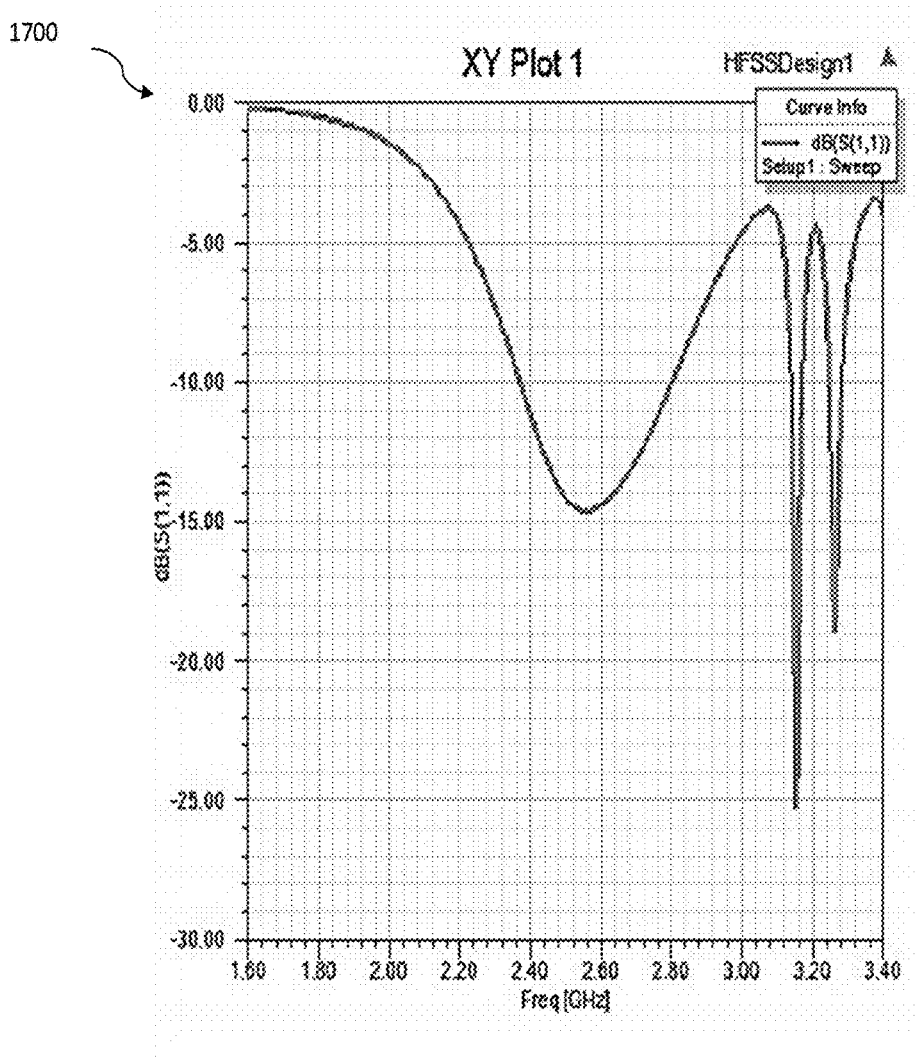
FIG. 17 is a graphical representation of simulation results, in accordance with an embodiment of the invention.
Figure 18:
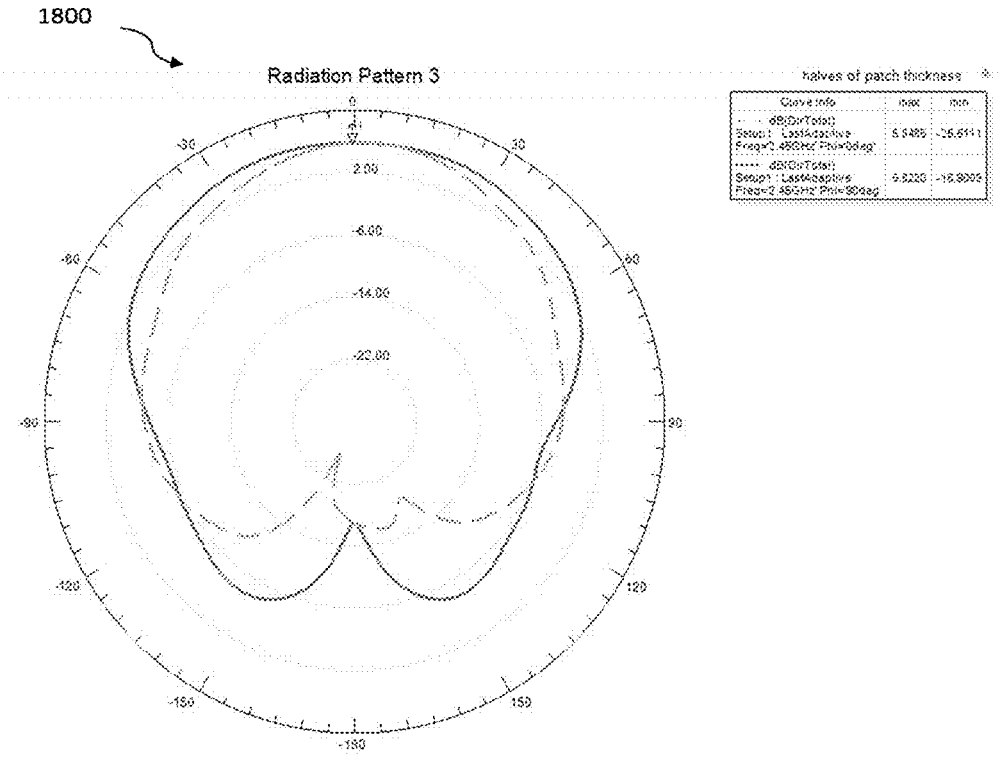
FIG. 18 is a graphical representation of simulation results, in accordance with an embodiment of the invention.

FIG. 17 is a graphical representation 1700 of return loss S(1,1) of the antenna 200, in accordance with an embodiment of the invention. As known in the prior art, S(1,1) represents how much power is reflected from the antenna, and hence is known as the reflection coefficient or return loss. FIG. 17 depicts a simulation result of the 2.4 GHz antenna. The bandwidth covers 2.4-2.8 GHz with S(1,1)<−10 dB. The simulated gain achieves 4 dBi with omnidirectional like radiation pattern, as depicted in graph 1800 in FIG. 18.

Figure 19:
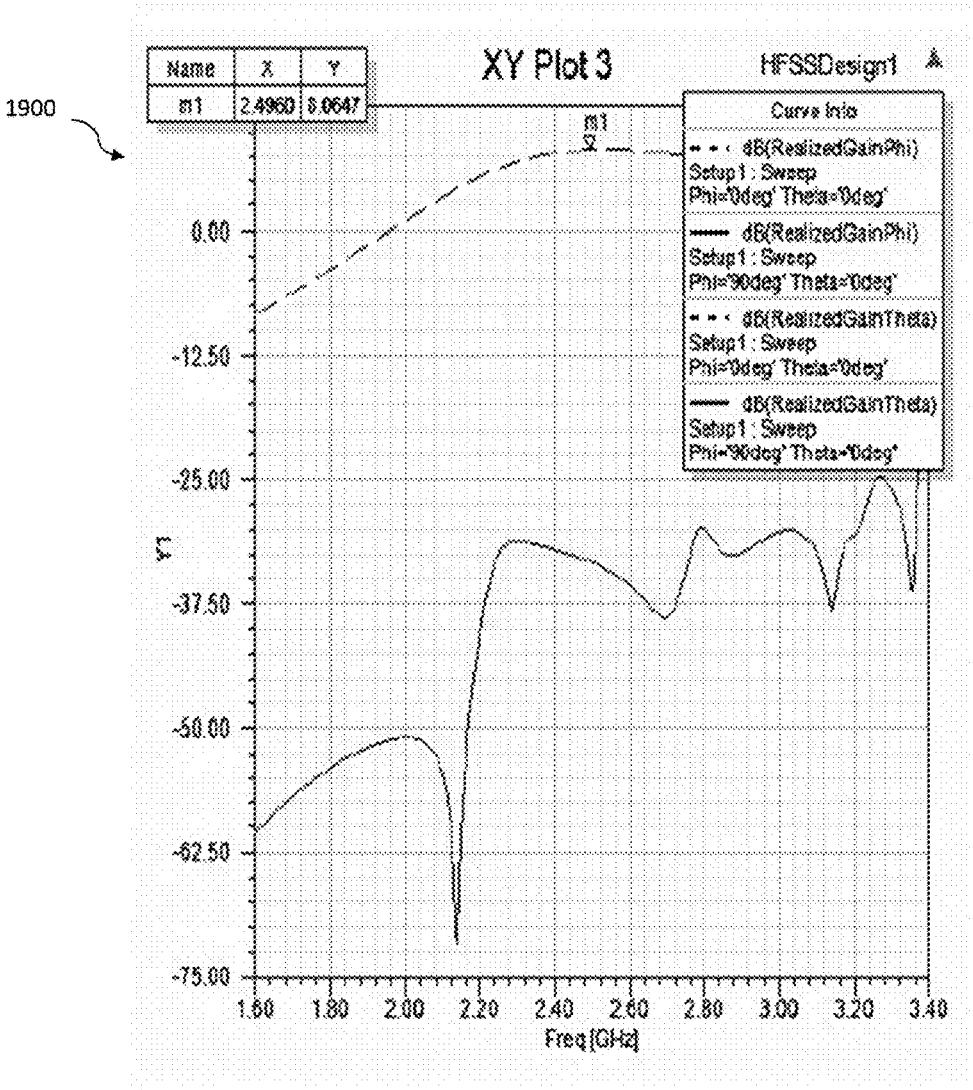
FIG. 19 is a graphical representation of antenna gain, in accordance with an embodiment of the invention.

FIG. 19 shows graphic 1900 displaying Radiated Field of the Antenna 200. This is an E field of the antenna at 2.4 GHz.

Figure 20:
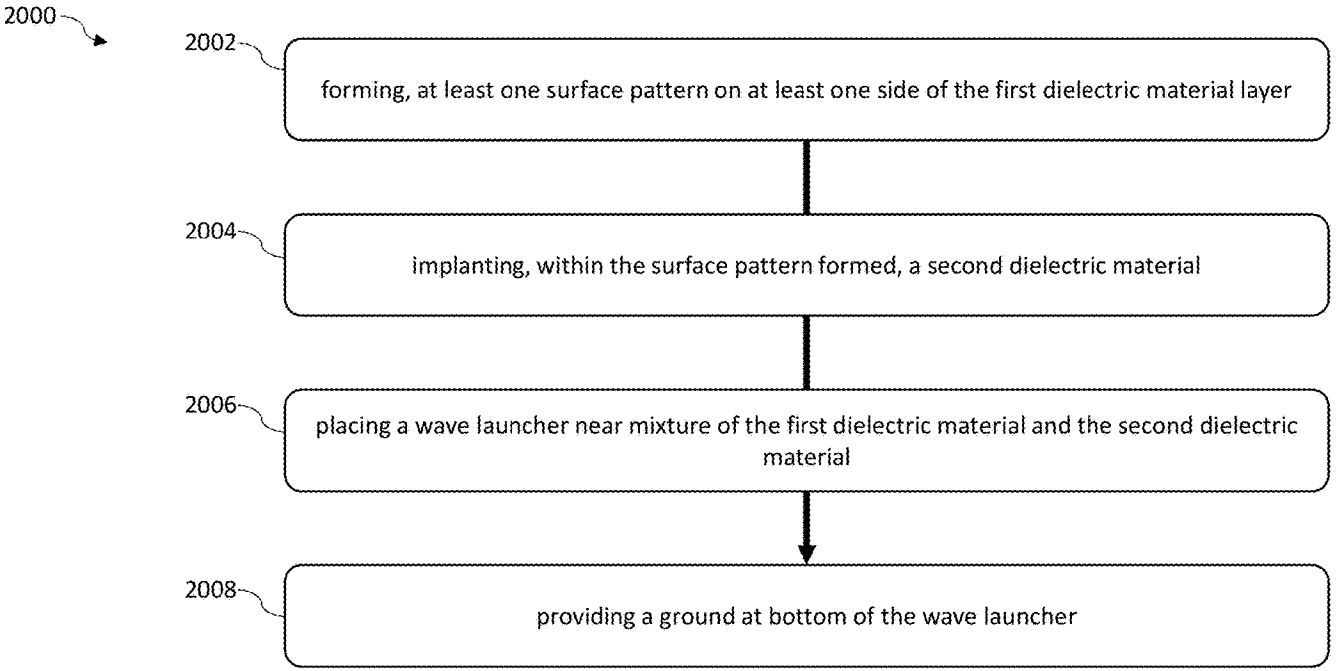
FIG. 20 is a flowchart depicting a method to enable a material layer to become an antenna, in accordance with an embodiment of the invention.

FIG. 20, a flowchart illustrating a method 2000 to enable a first antenna layer to become an antenna, in accordance with an embodiment of the invention. The order in which the method is described is not intended to be construed as a limitation, and any number of the described method blocks can be combined in any order to implement the method or alternate methods. Additionally, individual blocks may be deleted from the method without departing from the spirit and scope of the subject matter described herein.

At step 2002, the method 2000 is initiated by forming a surface pattern on at least one side of a first material layer. The surface pattern may be in the form of pits or wells that may be formed by depressing one surface. As described earlier, the first material is of a low dielectric constant. The patterns may be formed by heating the first material and then forming the pattern using a mold for the formation of the pattern. The surface may then be cooled to retain the surface pattern formed.

Further, at step 2004, the pits of the surface pattern formed are then embedded or filled up with a second material. The dielectric constant of the second material may be higher than that of the first material. The second material may be filled using injecting apparatus or may be filled as a paste within the pits. The mixture is then allowed to cool off and form a first antenna layer.

At step 2006, a wave launcher that helps to couple energy to the first antenna layer is placed. The wave launcher is placed with an air gap in between the wave launcher and the first antenna layer. The wave launcher is a feeding device where the RF signal energy travels from the RF circuit on a circuit board placed below the surface of the first antenna layer. Further, an air gap is needed to excite energy from the RF circuit to the dielectric antenna surface.

At step 2008, a ground is provided at the bottom part of the wave launcher. The ground may also be provided with the RF circuit as discussed above.

While the invention has been described in detail with respect to the preferred embodiments thereof, it will be appreciated that upon reading and understanding of the foregoing, certain variations to the preferred embodiments will become apparent, which variations are nonetheless within the spirit and scope of the invention and the appended claims.

The spirit and scope of the invention should be determined by the appended claims and their legal equivalents, rather than by the examples are given.

The invention claimed is:

1. An antenna comprising:

a first antenna layer;

a wave launcher placed near to the first antenna layer and configured to couple energy generated from an energy source to the first antenna layer; and a ground placed at a bottom of the wave launcher;

wherein the first antenna layer comprises:

a first material layer, formed by a first material, configured with a surface pattern containing a plurality of pits; and a second material layer, formed by a second material having a different dielectric constant from a dielectric constant of the first material, implanted within at least one of the plurality of pits;

wherein each of the plurality of pits is implanted with a material having a different dielectric constant from the dielectric constant of the first material and dielectric constants of materials implanted within other pits.

2. The antenna of claim 1, further comprising an air gap between the wave launcher and the first antenna layer.

3. The antenna of claim 1, further comprising at least one additional antenna layer.

4. The antenna of claim 3, wherein the at least one additional antenna layer is of a same structure as the first antenna layer.

5. The antenna of claim 4, wherein the surface pattern of the at least one additional antenna layer is different from the surface pattern of the first antenna layer.

6. The antenna of claim 3, wherein the at least one additional antenna layer comprises a second antenna layer formed by a third material and a third antenna layer formed by a fourth material having a different dielectric constant from a dielectric constant of the third material.

7. The antenna of claim 6, wherein the second antenna layer is in a form of a thin film or a tape placed over a surface of the first antenna layer.

8. The antenna of claim 7, wherein the second antenna layer completely covers the first antenna layer.

9. The antenna of claim 6, wherein the second antenna layer comprises multiple portions discreetly covering the first antenna layer at regular intervals or irregular intervals.

10. The antenna of claim 1, wherein the plurality of pits have a varied volume.

11. The antenna of claim 1, wherein at least one of the dielectric constant of the first material and the dielectric constant of the second material is greater than or equal to 10 or within a range of 2-9.

12. The antenna of claim 1, wherein the first material is any one or a combination of a plastic, an Acrylonitrile butadiene styrene (ABS), a polycarbonate, a Polyurethane, a Carbon Fiber, and a Silicone.

13. The antenna of claim 1, wherein the second material is any one or a combination of an Alumina, a Zirconia, and a Titanium Dioxide.

14. The antenna of claim 1, wherein the wave launcher produces a phase difference of $0° \leq \Theta \leq 90°$ for resonant frequencies $f_M$ (M=1, 2, 3 . . . ) within the first antenna layer.

15. The antenna of claim 1, wherein the first antenna layer is a user device that is any one of a smartphone, a watch, a tablet computer, and a laptop.

16. The antenna of claim 1, wherein the first antenna layer is an add-on surface that is provided over a user device.

17. An antenna comprising: a first antenna layer; a wave launcher placed near to the first antenna layer and configured to couple energy generated from an energy source to the first antenna layer; and a ground placed at a bottom of the wave launcher; wherein the first antenna layer comprises: a first material layer, formed by a first material, configured with a surface pattern containing a plurality of pits; and a second material layer, formed by a second material having a different dielectric constant from a dielectric constant of the first material, implanted within at least one of the plurality of pits; wherein at least one of the plurality of pits is implanted with a third material layer formed by a third material having a different dielectric constant from the dielectric constant of the first material and the dielectric constant of the second material.

18. The antenna of claim 17, wherein at least one of the plurality of pits is implanted with the second material layer and the third material.

19. A method to enable material layers to become an antenna, the method comprising:

forming, at least one surface pattern on at least one side of a first material layer formed by a first material; the at least one surface pattern containing a plurality of pits;

implanting, within at least one of the plurality of pits, a second material layer formed by a second material having a dielectric constant different from a dielectric constant of the first material to form a first antenna layer;

implanting each of the plurality of pits with a material having a different dielectric constant from the dielectric constant of the first material and dielectric constants of materials implanted within other pits;

placing a wave launcher near the first antenna layer, wherein the wave launcher is configured to couple energy generated from an energy source to the first antenna layer; and providing a ground at a bottom of the wave launcher.

* * * * *